US005842255A

United States Patent [19]

Luca

[11] Patent Number: 5,842,255

[45] Date of Patent: Dec. 1, 1998

[54] DOOR CLOSERS WITH AUTOMATIC LATCHING OR/AND DELAYED ACTION

[76] Inventor: Valentin Luca, 125 Katona Dr. #4A6, Fairfield, Conn. 06430

[21] Appl. No.: 555,730

[22] Filed: Nov. 9, 1995

Related U.S. Application Data

[63] Continuation-in-part of Ser. No. 547,921, Oct. 25, 1995, Pat. No. 5,630,248, which is a continuation-in-part of Ser. No. 984,270, Dec. 3, 1997.

[51] Int. Cl.[6] ..... E05F 3/04

[52] U.S. Cl. ..... 16/51; 16/DIG. 9; 16/DIG. 17; 16/DIG. 21; 16/49

[58] Field of Search ..... 16/51–53, 66, 16/72, 82, 84, DIG. 9, DIG. 17, DIG. 21

[56] References Cited

U.S. PATENT DOCUMENTS

| | | | |
|---|---|---|---|
| 3,284,841 | 11/1966 | Patriquin | 16/52 |
| 3,416,182 | 12/1968 | Gibson | 16/52 |
| 3,781,943 | 1/1974 | Cain | 16/52 |
| 3,913,170 | 10/1975 | Nakane et al. | 16/56 |
| 4,382,311 | 5/1983 | Watts | 16/66 |
| 4,815,163 | 3/1989 | Simmons | 16/49 |
| 4,894,883 | 1/1990 | Fleischhauer | 16/66 |
| 4,920,609 | 5/1990 | Lin | 16/66 |
| 5,048,150 | 9/1991 | Gueria | 16/66 |
| 5,083,342 | 1/1992 | Klinefelter | 16/66 |
| 5,293,666 | 3/1994 | Armstrong | 16/66 |

*Primary Examiner*—Chuck Y. Mah
*Assistant Examiner*—Donald M. Gurley
*Attorney, Agent, or Firm*—Fattibene and Fattibene; Arthur T. Fattibene; Paul A. Fattibene

[57] ABSTRACT

The present invention discloses door closers provided with automatic latching in any position along the stroke, and delayed action mechanism together with a mechanism to switch on and off the automatic latching and the delayed action operation modes. The function, on which the automatic latching and the delayed action functions are based, are described in detail and examples of embodiments in door closers provided with either automatic latching or delayed action or both are also described.

10 Claims, 9 Drawing Sheets

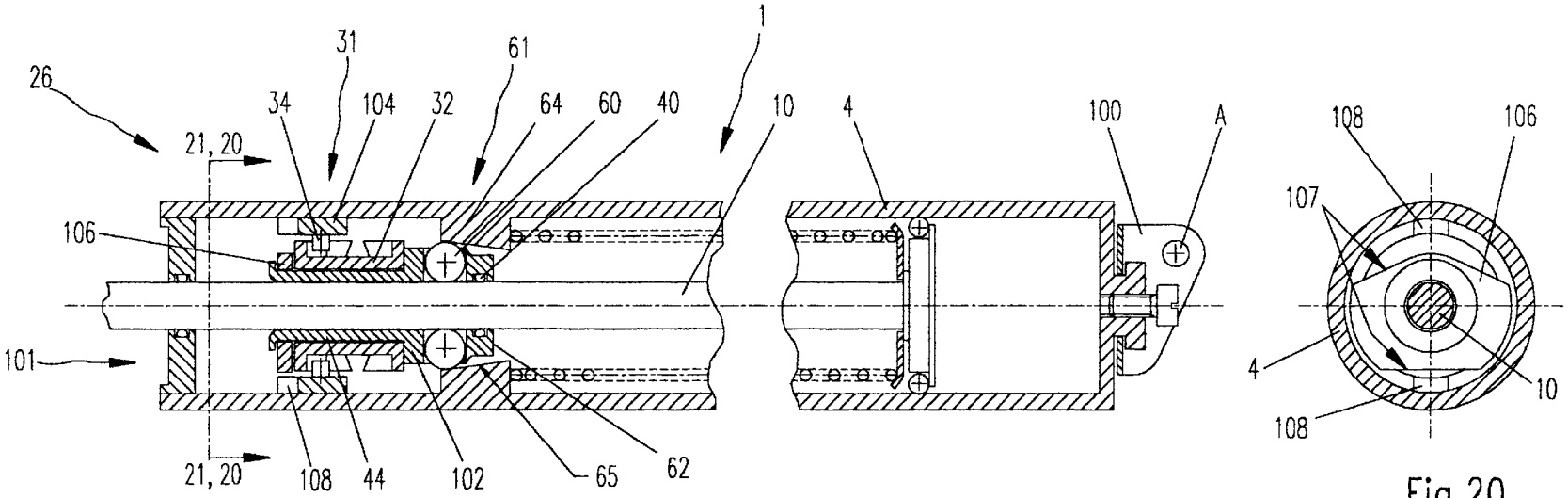
Fig.19
Fig.20
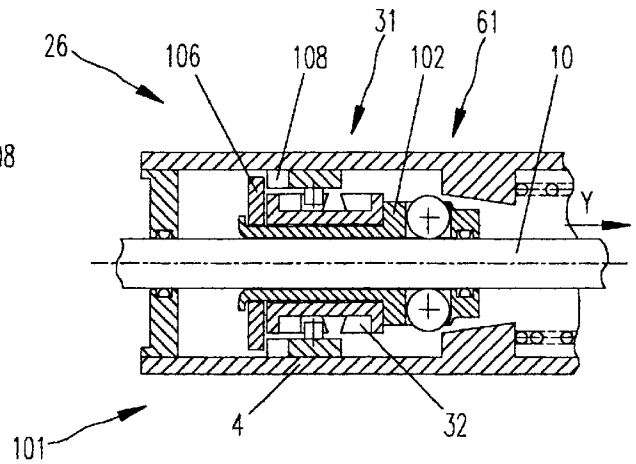
Fig.22
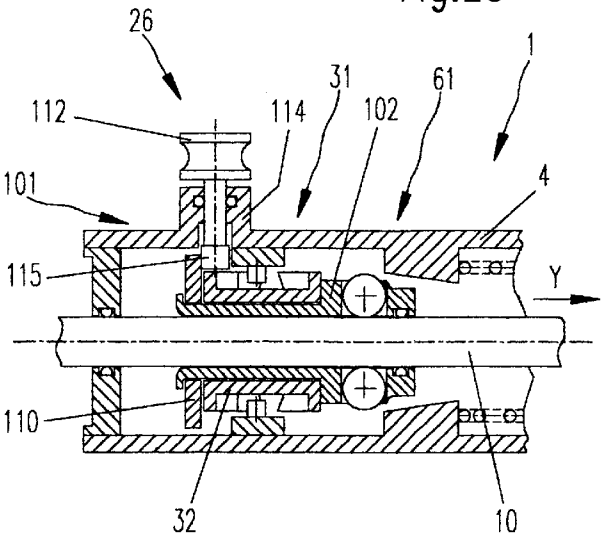
Fig.23
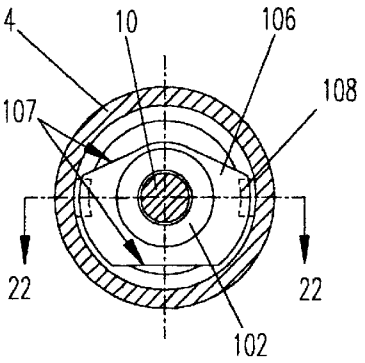
Fig.21

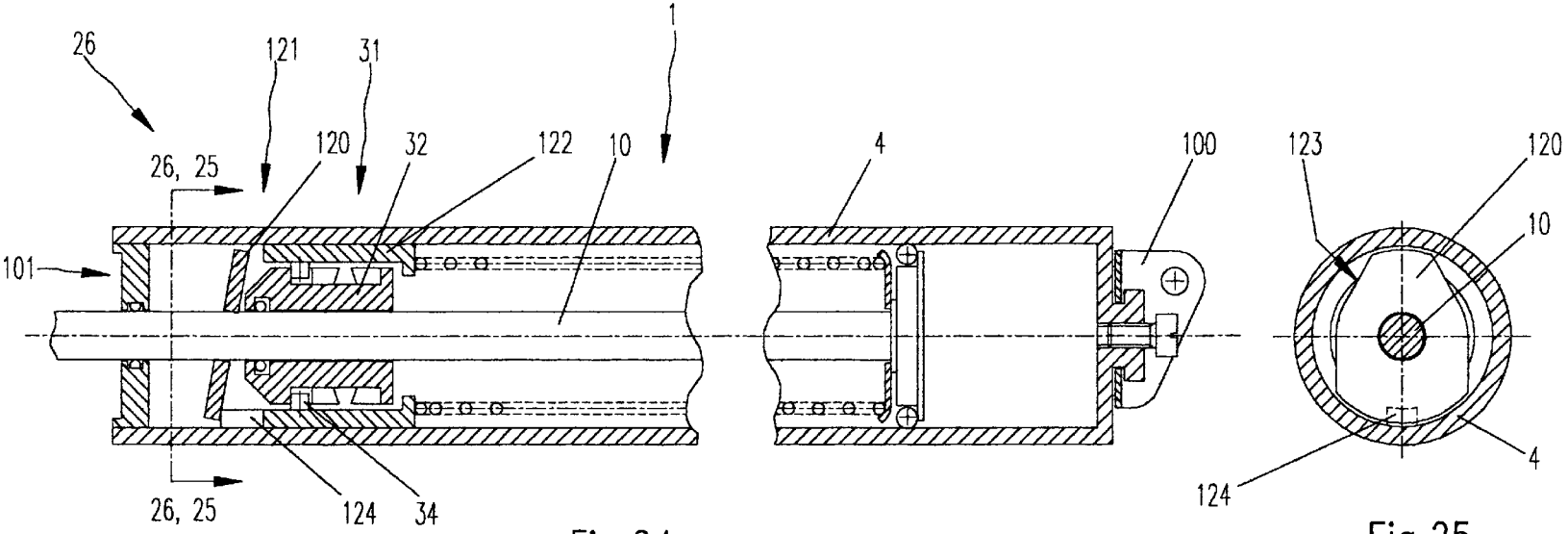
Fig.24
Fig.25
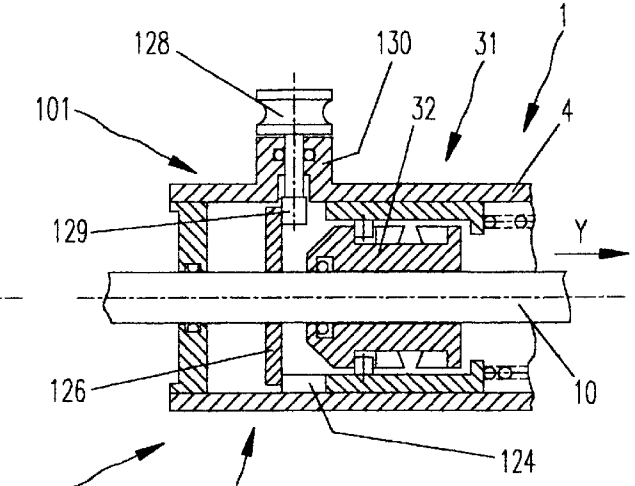
Fig.28
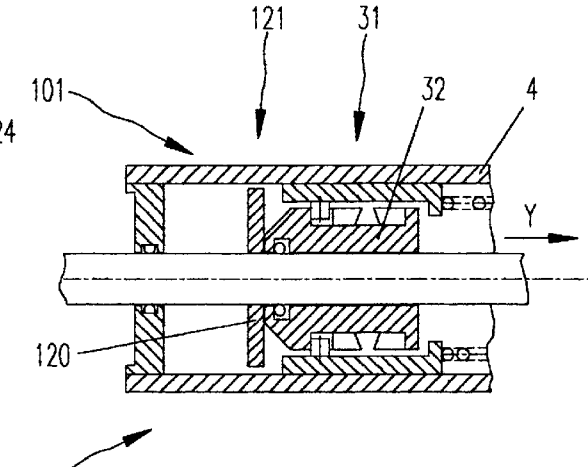
Fig.27
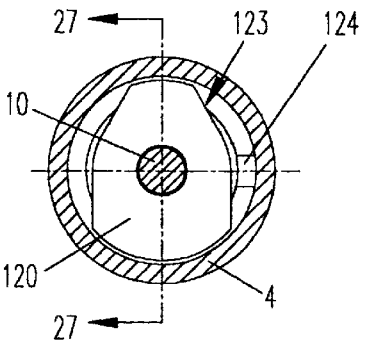
Fig.26

1
4
10
100
71
78
72
170
40
172
174
176
61
102
34
31
104
108
33
106
26
111
107
184
186
182
183
180
Y

DOOR CLOSERS WITH AUTOMATIC LATCHING OR/AND DELAYED ACTION

RELATED APPLICATIONS

This application relates to and is a continuation in part application of my application Ser. No. 547,921 filed Oct. 25, 1995, now U.S. Pat. No. 5,630,248, granted May 20, 1997.

Reference is also made to my co-pending application Ser. No. 08/984,270 filed Dec. 3, 1997, which is a continuation in part application of this application.

BACKGROUND OF THE INVENTION

1. Field of the Invention

The present invention relates to door closers based on compression coil spring force, the spring being enclosed in a cylinder containing gas or liquid which slows down and smoothes the closing. Disclosed herein are door closers provided with automatic latching in any position along the stroke or/and delayed action means.

2. Description of the Prior Art

There are many types and brands of door closers. Maybe the most common types are those based on the force of a compression coil spring which is enclosed in a cylinder. The closed end of the cylinder is attached to a bracket which is usually mounted on the door. The spring pushes on a piston which transmits the force to a rod which extends out of the cylinder, said rod being usually attached to a bracket mounted on the frame of the door. The cylinder contains gas or liquid, which slows down and smooth the closing movement and valve means are provided on the piston to allow for easy opening.

A manual hold-open latching feature is usually provided. In most of the cases, this is a washer which can slide on the rod but, it latches when the axial force is applied at a distance from the center of its hole. When the door is in an open position, the latching washer can be moved along the rod, close to the end of the cylinder and, when the door is left free, the cylinder will push on the washer eccentrically which leads to latching.

To unlatch the door, it is necessary to open it a bit more in order to release the washer free and manually bring it outside the stroke of the cylinder. The door closers of the type described above have been in use for a long time and, by being of a very simple construction, they are inexpensive and reliable. However this type of door closers has two major drawbacks: first, the manual latching operation, normally requires two hands, one to move the washer, the other hand, or at least some part of the body, being needed to prop the door open which is an inconvenience when carrying something; second, the door being permanently under the force of the spring, the closing movement starts immediately after the door is left free, forcing the person crossing through the door to rush or to keep the door propped open with a hand or another part of the body until that person gets out of the area swept by the door. This inconvenience is felt stronger in the case of the door closers damped by air in which the initial movement of the door is more violent since the spring is more compressed and the piston didn't travel enough to build up air pressure.

Works have been carried out to address one or the other of these drawbacks but, most of the proposed types of door closers fell short of achieving full market recognition, by providing only a partial solution to the drawbacks or by being expensive to manufacture.

Hence, without detracting from the operability or desirability of other door closers, it may be stated that the features and means disclosed by the present invention substantially adds to the user's convenience.

This invention introduces automatic latching systems means in which it is not necessary to move latching means manually. The automatic latching means claimed in this invention latch the door open when the door is left free, and unlatch it if a subsequent slight movement in the opening direction is applied. It is also important to note that the automatic latching systems disclosed herein work essentially anywhere along the stroke of the door closer, so for practically any meaningful position of the door. The present invention also discloses means to switch-off the automatic latching for the case when latching the door open is not desired.

The present invention also discloses delayed action system means, which, after the door is open, provide a delay of a few seconds before letting the spring free to start the closing movement. The delay can be adjusted upon user's convenience.

The present invention also discloses means of embodying the automatic latching and the delayed action features into the same door closer and means of switching between automatic latching and delayed action operation modes. Switching-off the delayed action when the automatic latching mode is switched-on is desirable since, the user may be confused if a latched door doesn't unlatch immediately after the appropriate action.

SUMMARY OF THE INVENTION

It is an object of the invention to realize door closers provided with automatic latching in essentially any position along the stroke. By automatic latching it is understood that, when the latching mode is on, after opening the door, this will remain open in essentially the last position, which can be anywhere along the stroke, and it will close if a subsequent slight movement toward opening is applied.

A further object of the invention is to provide means of switching on and off the automatic latching operation mode.

A further object of the invention is to realize door closers provided with delayed action. By delayed action it is understood that, when the door is left free after being opened, the spring will be left free to start the closing only after a delay which is adjustable according to the user's convenience.

A further object of the invention is to realize door closers provided with both automatic latching and with delayed action features.

A further object of the invention is to provide the door closers having both automatic latching and delayed action features with means of switching between the automatic latching and the delayed action operation modes.

BRIEF DESCRIPTION OF THE DRAWINGS

In order to fully understand the detailed description of the invention, the following drawings were attached, and wherein:

FIG. 19 is a longitudinal vertical cross-sectional view through a door closer provided with automatic latching means and means to switch-off the automatic latching operation mode; conical latching and turn around-centerline switching-off means shown.

FIG. 20 is a cross-sectional view taken along the line 20—20 of FIG. 19; cylinder is shown in latching-on position.

FIG. 21 is a cross-sectional view taken along the line 21—21 of FIG. 19; cylinder shown rotated in latching-off position.

FIG. 22 is a partial cross-sectional view taken along the line 22—22 of FIG. 21; view shown rotated for convenience.

FIG. 23 is a longitudinal partial cross-sectional view through a door closer provided with automatic latching and means to switch-off the automatic latching operation mode; conical latching and, pin-button switching-off means shown.

FIG. 24 is a longitudinal vertical cross-sectional view through a door closer provided with automatic latching and means to switch-off the automatic latching operation mode; latching washer and turn around-centerline switching-off means shown.

FIG. 25 is a cross-sectional view taken along the line 25—25 of FIG. 24; cylinder shown in latching-on position.

FIG. 26 is a cross-sectional view taken along the line 26—26 of FIG. 24; cylinder shown rotated in latching-off position.

FIG. 27 is partial cross-sectional view taken along the line 27—27 of FIG. 26.

FIG. 28 is a longitudinal partial cross-sectional view through a door closer provided with automatic latching and means to switch-off the automatic latching operation mode; latching washer and pin-button switching-off means shown.

DETAILED DESCRIPTION OF THE DRAWINGS

Figure 1:
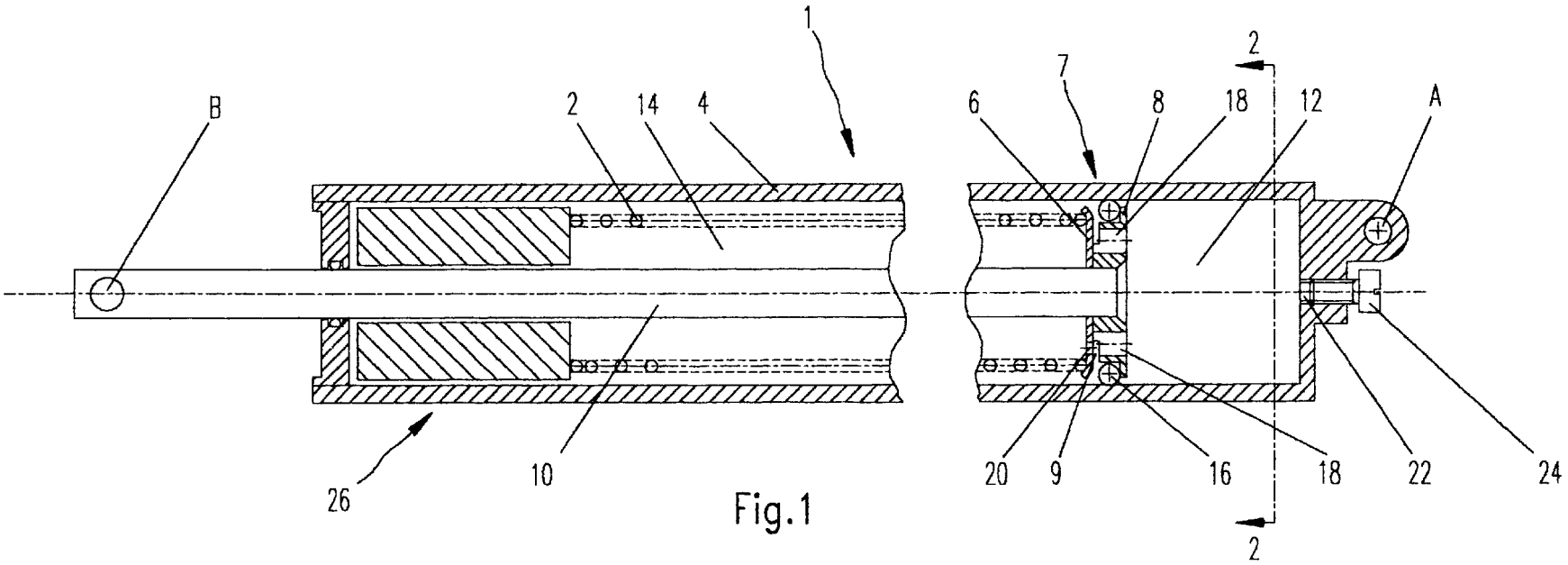
FIG. 1 is a longitudinal cross-sectional view through a door closer showing the arrangement of its classical main elements and of the function means disclosed in the present invention.

FIG. 1 is a longitudinal cross-sectional view through a door closer 1 showing the main feature means which are common to all the configurations of door closers disclosed in the present invention. The ends "A" and "B" are attached by means to brackets, not shown, said brackets being mounted on the door, respectively on the door's frame. The compression coil spring 2 is enclosed in the cylinder 4 defining a piston chamber having a piston 8 reciprocally mounted therein and which transmits its force through the washer 6 which is pushing against the piston 8 which is connected to the rod 10.

The sides of the door closer and its components oriented toward the end where the rod is extending out of the cylinder are named herein front sides, while the opposite sides are named herein rear sides.

The movement of the rod outward of the cylinder is named herein opening stroke and the movement of the rod inward the cylinder is named herein closing stroke. The cylinder 4 contains gas or liquid, named herein fluid, which is used to slow down and smooth the closing motion. Valve means 7 are provided on the piston to provide a differential damper, meaning that, during the movement of the piston, the displaced fluid will encounter more resistance when crossing from the chamber 12 to the chamber 14 (closing stroke) than when crossing from the chamber 14 to chamber 12 (opening stroke). The sealing means 16, shown as O-ring, is trapped between the washer 6 and the piston 8 and leans against the washer, providing an essentially good sealing during the closing stroke while. During the opening stroke, it leans against the piston 8 allowing the fluid to pass through clearance means 9 provided between the washer 6 and the piston 8 and through a plurality of holes 18 provided in the piston, said holes being shown in number of four in FIG. 2.

In the case the fluid cannot be wasted, the cylinder is adequately sealed and the fluid flows from the chamber 12 to the chamber 14 through one or a plurality flow metering holes 20 provided in the washer 6. In the case when the fluid is air, the chamber 14 is not essentially sealed and, during the closing stroke, the air from the chamber 12 flows out through the hole 22 provided with a screw 24 which can be of a tapered type and serves as a speed adjusting means. The door closer in FIG. 1 is provided with function means 26 which realize automatic latching or/and delayed action functions.

The figures part of this invention show sealing means as for fluid that cannot be wasted but, for simplicity, no description of these sealing means is provided unless this is essential for understanding of the operating principles of the door closers disclosed herein. It is also understood that, in the case of fluid being air, some sealing means are not necessary.

FIGS. 3 through 11 show the cam means 31 which is one of the elements used to realize the automatic latching function of the door closer disclosed herein.

Figure 4:
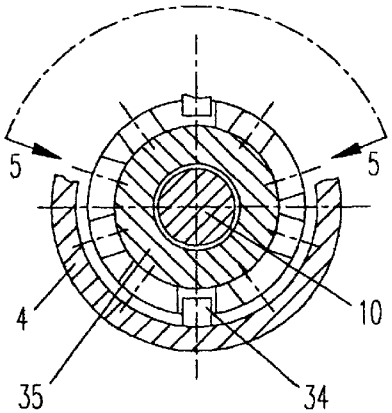
FIG. 4 is a cross-sectional view taken along the line 4—4 of FIG. 3.
Figure 5:
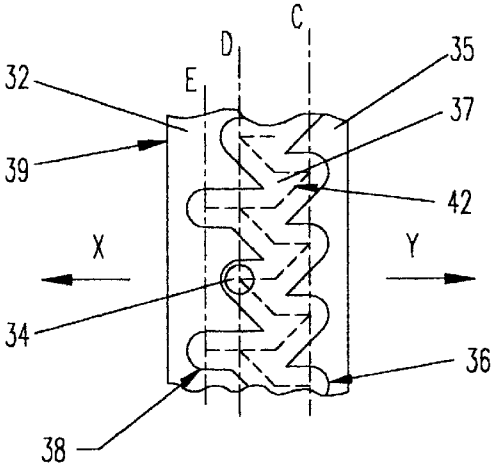
FIG. 5 is a view taken in the direction 5—5 indicated in FIG. 4; cylindrical surface flattened for clarity.

FIGS. 3 through 11 show a dual circumferential cam 32, named herein cam, which is mounted and free to rotate on the rod 10. The body 35 of the cam 32 has an essentially barrel shape and it has on its cylindrical face a circumferential channel 37, the sides of said channel forming two correlated cam profiles which extend in axial direction having the flanks extending in radial direction. Essentially fixed in respect to the cylinder 4, a plurality of teeth means or cam followers 34 are provided, said teeth or cam followers shown in number of two, protruding into the cam channel 37. FIG. 5 shows the cam profiles making-up the channel, the cylindrical surface being flattened for clarity. Each individual cam profile 36 and 38 is made of an even plurality of shaped cuts means, named herein cuts, the angular distance between two adjacent said cuts being named herein pitch. The cuts are essentially the same, except that half of number of said cuts are deeper in axial direction, said half being alternatively distributed along at least one cam profile; FIG. 5 and all the embodiments disclosed herein show only one cam profile, 38, having deeper cuts.

When the cam 32 is moved axially by the rod 10 through rubber or spring friction means 40, the cam will rotate half pitch when leaning against the teeth 34 and, when the rod is moved in the opposite direction, the cam will rotate another half pitch in the same direction, the path 42 of a tooth 34 in respect to the cam channel 37, being shown in FIG. 5.

The side of the cam 39 closest to said deep cuts is named herein front side and in the embodiments disclosed herein, the cam is positioned with its front side oriented toward the front side of the door closer, such that, during the opening strokes, cam 32 moving in the direction X, It has the teeth 34 in the plane C and, during the closing strokes, cam moving in the direction Y, the cam has the teeth 34 alternatively in the plane D and essentially in the plane E.

Figure 6:
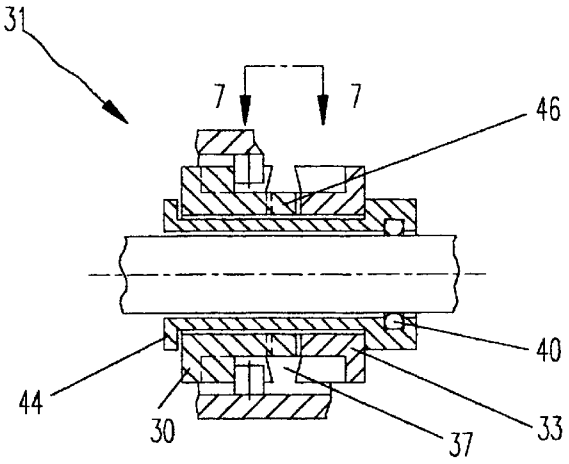
FIG. 6 is a longitudinal cross-sectional view through a cam of central type made out of two pieces mounted on cam carrier.
Figure 7:
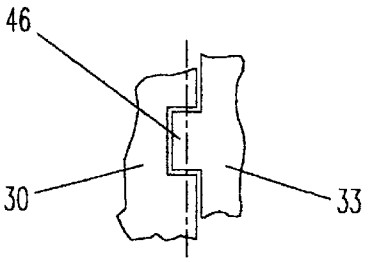
FIG. 7 is a view taken in the direction 7—7 indicated in FIG. 6 showing generic indexing means of the two pieces making-up the cam shown in FIG. 6.
Figure 3:
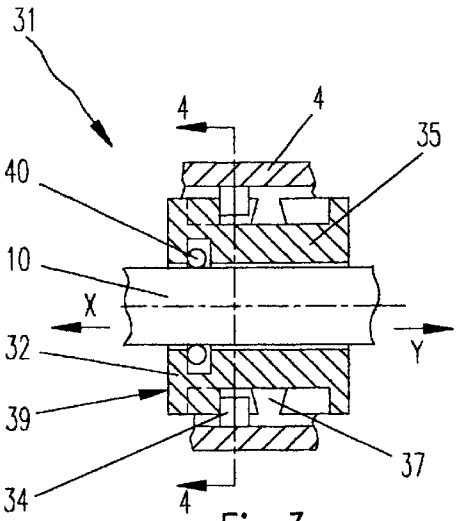
FIG. 3 is a longitudinal cross-sectional view through a cam which is part of the automatic latching means; central cam configuration shown.

FIG. 6 shows a cam which is functionally identical with the cam shown in FIGS. 3, 4, 5 the difference being that it is made out of two mating pieces, 30 and 33, which may be advantageous for manufacturing. The two mating pieces are held together by cam mounting means which is shown as a cam carrier 44 which has also provisions made to accommodate the friction means 40. The two mating pieces 30 and 33 of the cam are kept in angular correlation one in respect to the other by indexing means 46 which are generically represented in FIG. 7 which is a view in the direction 7—7 shown in FIG. 6.

The cam carrier 44 is a key means in linking the necessary elements to realize the desired functions in the disclosed door closers and is not necessarily related to the cams made out of two pieces which can be joint together by bonding or other mounting means.

Figure 11:
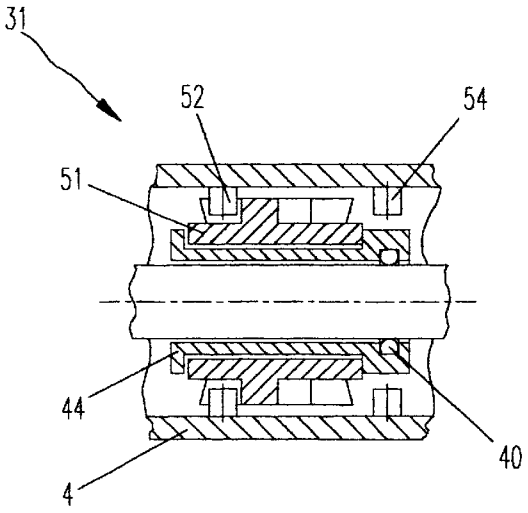
FIG. 11 is a longitudinal cross-sectional view through a side cam mounted on cam carrier.
Figure 9:
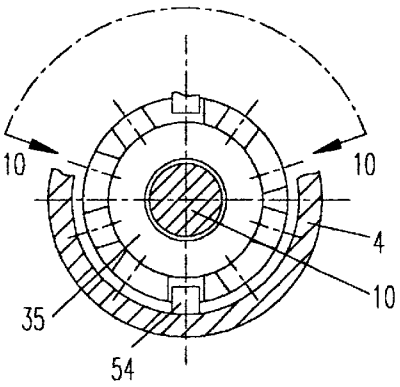
FIG. 9 is a cross-sectional view taken along the line 9—9 of FIG. 8.
Figure 8:
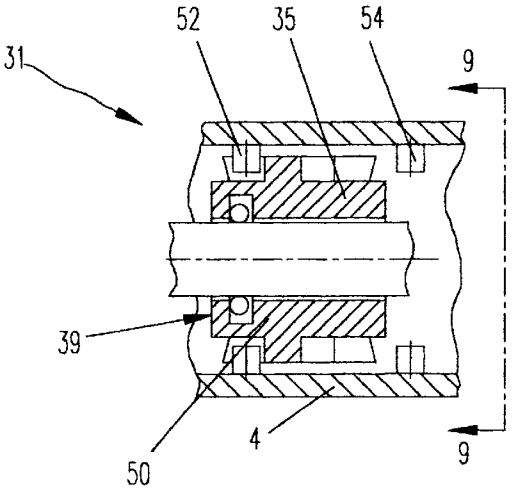
FIG. 8 is a longitudinal cross-sectional view through a cam which is part of the automatic latching means; side cam configuration shown.
Figure 10:
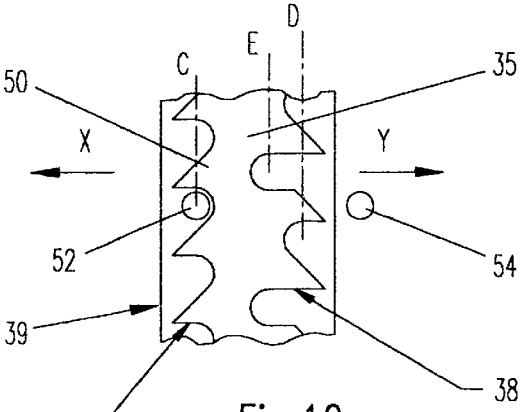
FIG. 10 is a view taken in the direction 10—10 indicated in FIG. 9; cylindrical surface flattened for clarity.

FIGS. 8 through 11 show a cam 50 which is functionally identical with the cam shown in FIGS. 3 through 6 the difference being that the cuts which are making-up the two correlated cam profiles 36 and 38 are provided on the flat ends of the body 35 of the cam and two rows of teeth 52 and 54 are used. The cam shown in FIGS. 8 through 11 is named herein side cam to distinguish it from the cam shown in FIGS. 3 through 6 which is named herein central cam. Referring to the flattened view of the cam profile shown in FIG. 10, it can be seen that, the cam 50 is oriented such that, during the opening strokes (cam moving in the direction X) it has the teeth 52 in the plane C and, during the closing strokes, the cam has the teeth 54 alternatively in the plane D and essentially in the plane E. The planes were marked with the same letters, C, D, E in both FIG. 5 and FIG. 10 to emphasize the essentially same functionality of central and side types of cams. The side of the side cam 39 which is furthermost from said deep cuts is named herein front side. FIG. 11 shows a side cam 51 mounted on cam carrier means 44 which is provided with means to accommodate the friction means 40. Since the cams shown in FIGS. 3 through 11 are based on the same operating principles, for simplicity, only the one piece, central cam, mounted or not on cam carrier means will be shown embodied in the door closers provided with automatic latching which are disclosed in the present invention. It is understood that any person having minimal knowledge in the art will be able to use any of the cam configurations described herein.

Figure 14:
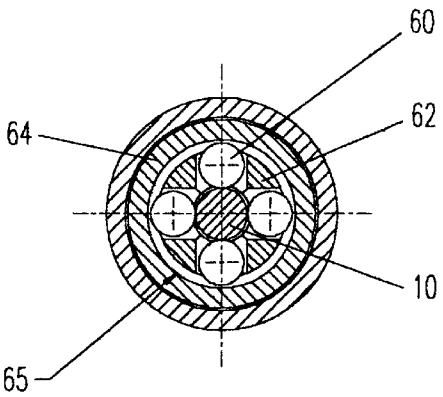
FIG. 14 is a cross-sectional view taken along the line 14—14 of FIG. 12.
Figure 12:
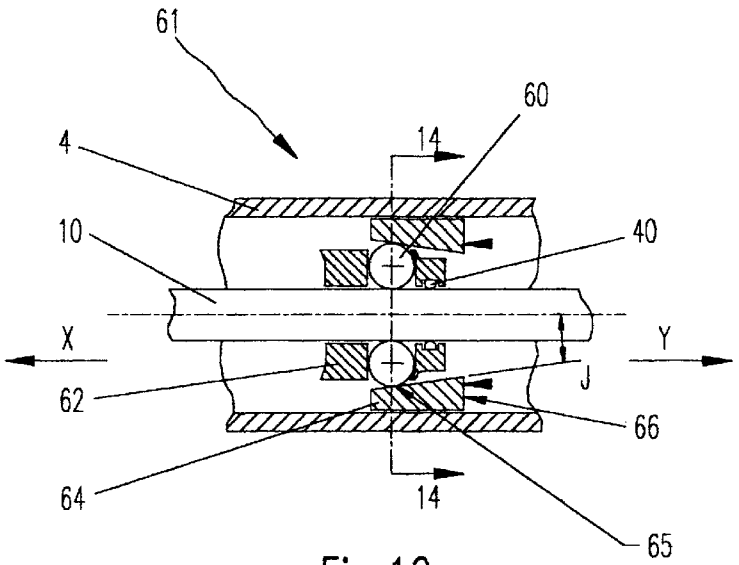
FIG. 12 is a longitudinal cross-sectional view through a conical latching system.
Figure 13:
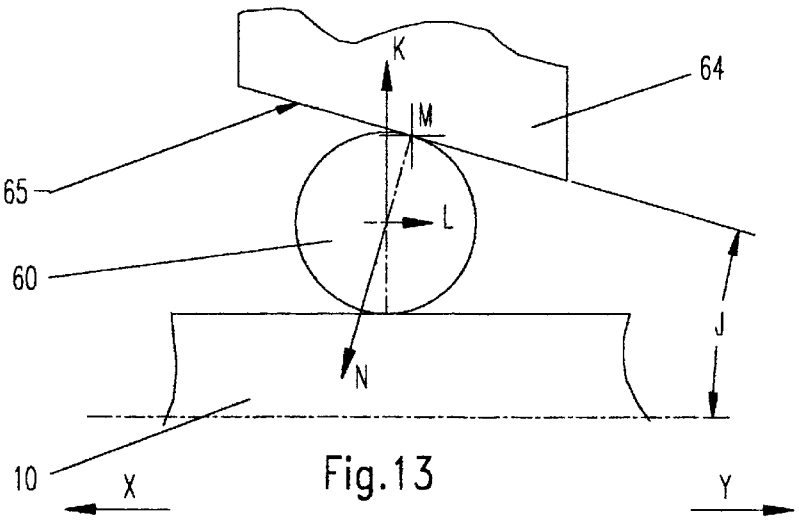
FIG. 13 is an enlarged schematic view showing the principles of operation of the conical latching system.
Figure 16:
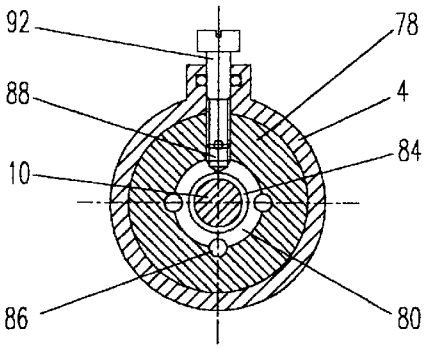
FIG. 16 is a cross-sectional view taken along the line 16—16 of FIG. 15.

FIGS. 12 through 14 show the latching means 61 which is one of the elements used to realize the automatic latching function of the door closers disclosed herein.

FIG. 12 shows latching system means, named herein conical latching means, comprising a plurality of balls or other essentially at least one axis round pieces means 60 hold together around the rod 10 by holder means 62 and a piece means 64, named herein angled piece and which is part of, or mounted in the cylinder 4, said angled piece 64 being shown in FIGS. 12 and 14 as a separated piece able to slide along the cylinder 4 and supported in the direction Y by means, not shown for simplicity, acting on the face 66. The angled piece 64 has an internal conical face 65 when used in conjunction with balls means or, individual angled facets 65 distributed around the centerline when working with other types of round pieces means 60, said conical surface or said angled facets being at an angle J in respect to the centerline.

During the closing stroke (rod 10 moving in the direction Y) the rod, through friction means 40 provided on the holder means 62, moves the round pieces 60 toward the angled facets 65, bringing the round pieces in simultaneous contact with the rod and the angled facets.

FIG. 13 is a schematic detail view showing the radial force K, shown as acting from the rod 10 to the round piece 60. Said force K acts when the rod 10 is pulled with the force L in the direction Y, round pieces means 60 being in simultaneous contact with the angled facets 65 and with the rod 10. The contact line or point M is a pivot center against which the round piece 60 tries to rotate when driven by the friction with the rod. The basic system of forces K, L, N acting on the round pieces is shown in FIG. 13 as acting in the center of the round pieces. Below certain values of the angle J, the friction force capacity which is defined herein as the product of the friction coefficient between the rod 10 and the round pieces 60 with the radial force K, said force K being produced by the puling force L, said friction force capacity is always greater than the pulling force L.

If, in conjunction with other mechanisms disclosed in the present invention, the holder means 62 prevents the simultaneous contact of the round pieces 60 with the rod 10 and the angled facets 65, the conical latching mechanism doesn't latch.

If, in a latched conical latching mechanism, in conjunction with other mechanisms disclosed in the present invention, the angled piece 64 is allowed to slide in the direction Y, while the movement of the holder means 62 is limited in the direction Y, the simultaneous contact of the round pieces 60 with the angled facets 65 and the rod 10 is broken and the mechanism unlatches.

FIG. 14 is a cross-sectional view taken along the line 14—14 of FIG. 12, showing a particular embodiment using four balls as round pieces means 60 in conjunction with a conical face 65 provided on the angled piece 64.

Since the operating principles are the same, irrespective to the shape of the round pieces and the associated angled facets, for simplicity, only the ball-cone configurations will be shown embodied in the door closers disclosed in the present invention. It is understood that any person having minimal knowledge in the art, based on the principles disclosed herein, will be able to use any of the other round pieces-angled facets shapes combinations.

FIGS. 15 through 18 show the means 71 used provide the delayed action function for the door closers disclosed in the present invention. Said mechanism is named herein delaying chamber. The delaying chamber has a cavity 70, named herein delaying cavity, formed in the cylinder 4 by a free piston 72 and a diaphragm 78, the rod 10 being able to slide both through the free piston and through the diaphragm. The free piston 72 can slide axially within the cylinder 4 and is provided with low friction sealing means 74 and with high friction sealing means 76. The diaphragm 78 is essentially fixed and sealed to the cylinder 4. The delaying cavity 70 is connected with the piston chamber 14 of the cylinder 4 through adjustable flow metering means 73 and valve means 75 which are shown provided on the diaphragm 78 The free piston side of the delaying chamber is named herein front side and, in the embodiments disclosed herein, the front side of the delaying chamber is oriented toward the front side of the door closer.

During the opening stroke of the door closer (rod moving in the direction X) the free piston 72 moves in the same direction, the increasing volume of the delaying cavity 70 being filled with fluid. The stroke of the free piston 72 is relatively small compared with the stroke of the rod 10. During the closing stroke, the latching means (not shown for clarity) pushes in the rearward Y axial direction on the face 79 of the free piston 72 which pressurizes the fluid contained in the cavity 70. As the fluid is metered out from the cavity 70, said latching means move relatively slowly rearwards (in the direction Y) and, provision is made such that, before the free piston 72 reaches the partition or diaphragm 78, said latching means get unlatched by having the holder means stopped by stroke limiting means (not shown in FIG. 15) provided within the cylinder 4.

Figure 17:
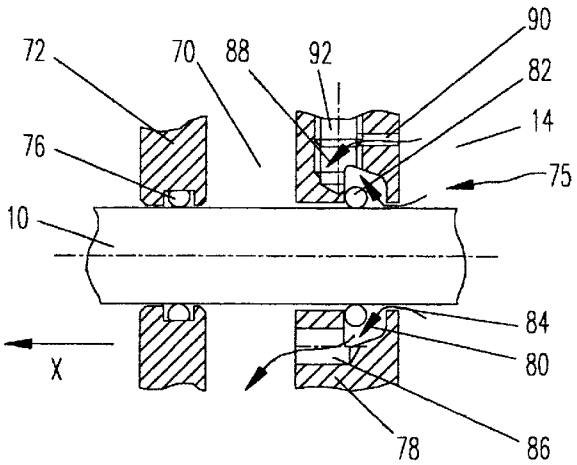
FIG. 17 is a detail longitudinal cross-sectional view showing the flow path of the fluid entering the delaying cavity, during the opening stroke.

FIG. 17 is a detail cross-sectional view showing the flow path of the fluid entering the cavity 70 and the operation of the valve means 75 during the opening stroke. The free piston 72 moves in the direction X being driven by the rod 10 through the friction with the sealing means 76 and by the fluid entering the cavity 70 from the chamber 14 of the cylinder. The sealing means 82 are moved by the rod 10 in the direction X, allowing fluid from chamber 14 to enter through the clearance 84 between the rod 10 and the diaphragm 78 in the cavity 80 in which sealing means 82 is trapped. From the cavity 80 the fluid enters the cavity 70 bypassing the sealing means 82 through passage means which can be slots and/or holes discharging in the cavity 70. In FIG. 15 through 18 the passage means are shown in the form of a plurality of holes 86. A relatively small amount of fluid will enter the cavity 80 through the flow metering passage, see below.

Figure 18:
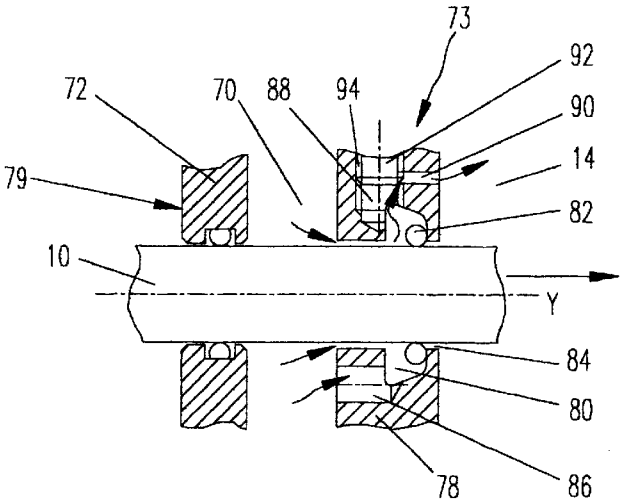
FIG. 18 is a detail longitudinal cross-sectional view showing the metered flow of fluid exiting the delaying cavity during the delayed portion of the closing stroke.
Figure 15:
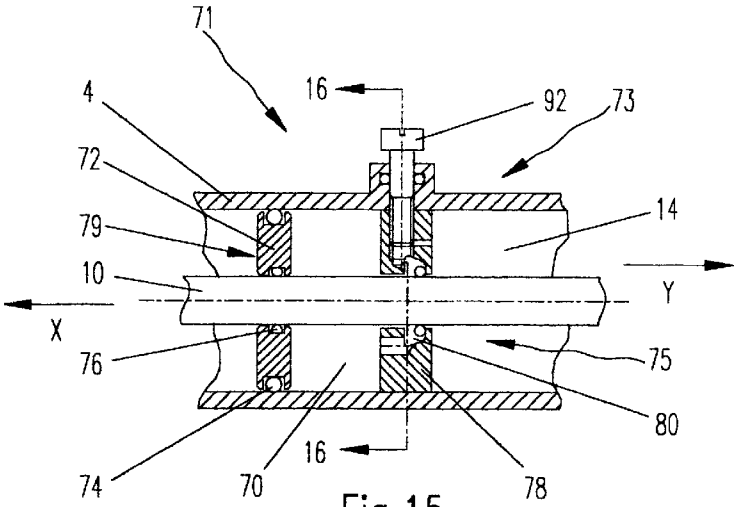
FIG. 15 is a longitudinal cross-sectional view through a delaying chamber which is part of the delayed action systems means.

FIG. 18 is a detail cross-sectional view showing the flow metering means 73 and the flow path of the fluid exiting the delaying chamber during the delayed portion of the closing stroke. The movement of the rod 10 in the direction Y brings the sealing means 82 in a position in which it seals the clearance 84 between the rod 10 and the diaphragm 78 and the fluid, under the pressure of the free piston 72, exits the delaying cavity 70 through the cavity 80 and continues through a connector threaded hole 88 and a metering hole 90. The screw 92 is delay adjusting means which adjust the amount of obturation of the metering hole 90, and hence adjust the speed of the free piston during the delayed portion of the closing stroke. In the case of the fluid being air, the air can be released directly to atmosphere through gap means 94 provided in-between the threaded hole 88 and the screw 92.

FIG. 19 is a longitudinal vertical cross-sectional view through a door closer 1 provided with automatic latching and turn around centerline type means to switch off the automatic latching operation mode. In addition to the elements described in conjunction with FIGS. 1 and 2, this door closer is provided with means which allow the cylinder 4 being turned around its centerline, means which are generically represented in FIG. 19 as a bracket 100 providing the attachment point A, said bracket being attached to the cylinder 4 by means which allow its rotation in respect to the centerline.

The function means 26 comprise:

cam means 31, the cam 32 being shown as an one piece, central cam type, mounted on cam carrier 44, the teeth 34 (see also FIG. 3) being attached to the cylinder 4 by mounting means 104.

conical latching means 61, shown as a ball-cone type, the angled piece 64 (see also FIG. 12) being shown for simplicity as part of the cylinder 4. The holder means 62 (see FIG. 12) is integrated with the cam carrier means 44 (see FIG. 6) into a common part 102, named herein holder-carrier, and having common friction drive means 40 (see also FIGS. 6 and 12). The distance between the teeth 34 and the conical face 65 is such that, during a closing movement, when the cam has the teeth in the plane D (see FIG. 5), the balls 60 are not in simultaneous contact with the conical face 65 and the rod 10 making latching impossible and, when the cam has the teeth in or close to plane E (see FIG. 5), the balls 60 are in simultaneous contact with the rod 10 and the conical face 65 and the latching is enabled.

latching switch-off means 101, provided by the shaped limiting washer 106 mounted on the holder-carrier 102 and the blocking teeth 108 provided either on the cylinder 4 or on the teeth mounting means 104. The shaped washer 106 is free to rotate around its center-hole and has means to bring its center of gravity off-set in respect to the center of its hole and, on the periphery of said washer, one or a plurality of cuts means 107 (see FIGS. 20 and 21) which can be the same means used to off-set the center of gravity, said cuts being of adequate size and position to let the teeth 108 pass through.

The automatic latching is switched-on when the cylinder 4 is turned around its centerline such that the blocking teeth 108 are out of the way of the shaped washer 106, as shown in FIG. 20, and the holder-carrier 102 is enabled to travel its full stroke within the limitation set by the cam means 31.

The automatic latching is switched-off when the cylinder is rotated such that the blocking teeth 108 are in the way of the shaped washer 106 as shown in FIGS. 21 and 22 and the stroke of the holder-carrier 102 is limited such that latching is not possible irrespective to the angular position of the cam 32.

FIG. 23 is a partial longitudinal cross-sectional view through a door closer 1 as described in conjunction with FIG. 19, except that the latching switch-off means 101 is of different type. The stroke limiting washer 110 can be fully circular in this case and means to allow the cylinder being rotated around its centerline are not mandatory. The stroke of the holder-carrier 102 can be limited and latching made impossible by the pin-button 112 mounted by holding and guidance means 114 on the cylinder 4.

The automatic latching is switched-off when the pin-button 112 is pushed by user such that its pin side protrudes inside the cylinder, as shown in FIG. 23 and its end 115 comes in the way of the limiting washer 110 limiting the stroke of the holder-carrier 102 such that latching is not possible irrespective to the angular position of the cam 32.

FIG. 24 is a longitudinal cross-sectional view through a door closer 1 provided with automatic latching and turn around centerline type means to switch off the automatic latching operation mode. In addition to the elements described in conjunction with FIG. 1 and 2, this door closer is provided with means which allow the cylinder 4 to be turned around its centerline as described in conjunction with the FIG. 19.

The function means 26 comprise:

Latching washer means 121, the latching washer 120 shown as being of flat construction.

Cam means 31, the cam 32 being shown as an one piece, central cam type mounted directly on the rod 10 as shown in FIG. 3, the teeth 34 being attached to the cylinder 4 by mounting means 122. On the same mounting means 122, or directly on the cylinder 4, a tooth 124 is provided, said tooth providing the eccentric support in axial direction which the latching washer 120 needs in order to latch. The axial distance between the teeth 34 and the tooth 124 is such that, during a closing movement (rod 10 moving in the direction Y), latching is possible only when the cam 32 has the teeth 34 in or close to the plane E (see FIG. 5) when the latching washer 120 is supported in axial direction eccentrically only by the tooth 124, while for other positions of the cam 32, latching is impossible the cam providing an essentially symmetrical axial support for the latching washer 120.

The means to switch-off the automatic latching 101 comprise, on the latching washer 120 means provided to bring its center of gravity off-set in respect to the center of its hole and on the periphery of said latching washer, one or a plurality of cuts means 123, which can be the same means used to off-set its center of gravity, said cuts being of adequate size to let the tooth 124 pass through.

When the cylinder 4 is turned around its centerline such that the tooth 124 is out of the way of the latching washer 120, as shown in FIGS. 26 and 27, the latching washer does not get the eccentric axial support and latching is not possible, irrespective to the angular position of the cam 32.

FIG. 28 is a partial longitudinal cross-sectional view through a door closer 1 as described in conjunction with FIG. 24 except that the latching switch-off means 101 is of different type. The latching washer 126 can be fully circular in this case and means which allow the cylinder 4 being turned around its centerline are not mandatory. The latching switch-off means are provided by the pin-button 128, mounted by holding and guidance means 130 on the cylinder 4.

Automatic latching is switched-off when said pin-button is pushed by user such that its pin side 129 protrudes inside the cylinder as shown in FIG. 28, and its end 129 provides, together with the tooth 124, an essentially symmetric axial support for the latching washer 126, making latching impossible, irrespective to the angular position of the cam 32.

Figure 2:
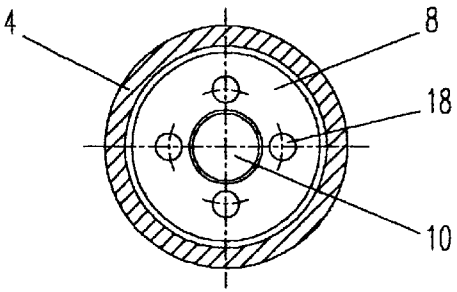
FIG. 2 is a cross-sectional view taken along the line 2—2 of FIG. 1.
Figure 29:
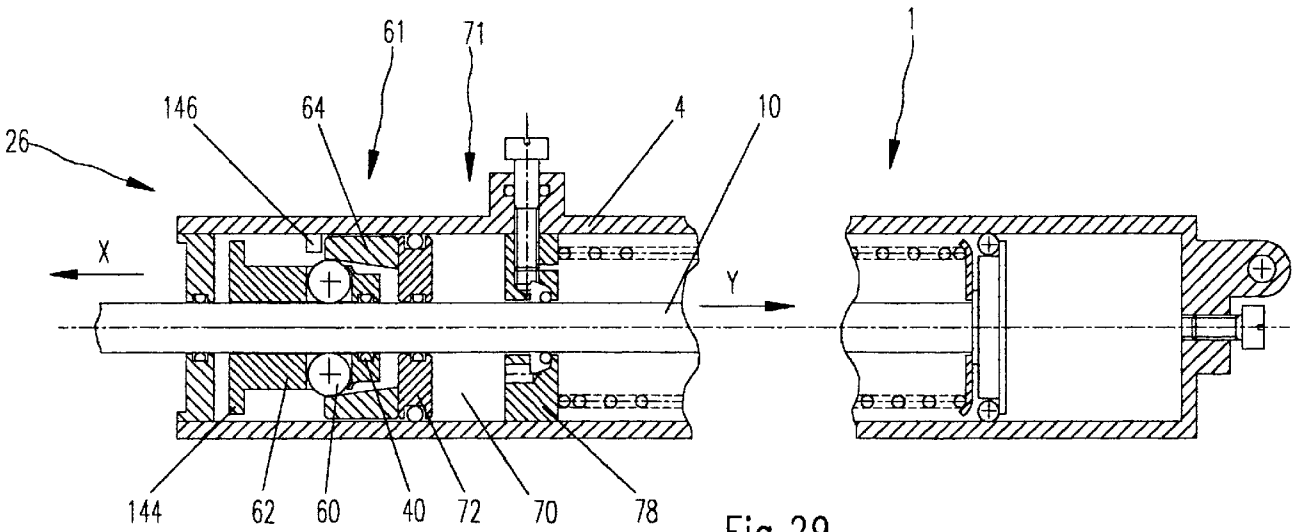
FIG. 29 is a longitudinal cross-sectional view through a door closer provided with delayed action; conical latching in conjunction with delaying chamber means shown.

FIG. 29 is a longitudinal cross-sectional view through a door closer 1 provided with delayed action which has all the elements described in conjunction with FIGS. 1 and 2, and where the function means 26 comprise:

Conical latching means 61 shown as a ball-cone type sleeve or annular member 64 (see also FIGS. 12 through 14), the angled piece or sleeve 64 being slidable inside the cylinder 4, the holder means 62 being provided with axial movement limitation means, shown as a shoulder 144 in FIG. 29.

Delaying chamber means 71 which has all the elements as described in conjunction with FIGS. 15 through 18.

The angled piece 64 is supported in rearward axial direction by the free piston 72. During the opening stroke (rod 10 moving in the direction X) the holder means 62 is driven by the rod 10 through friction means 40, the free piston 72 being driven in the same direction as described in conjunction with FIGS. 15 through 18. During the closing stroke (rod 10 moving in the direction Y) the conical latching mechanism latches and the rod 10 continues to move slowly, movement controlled by the rate of metered flow of fluid out of the delaying cavity 70. Provision is made that, before the free piston 72 gets in contact with the diaphragm 78, the holder means 62 gets stopped by stroke limiting means, fixed inside the cylinder 4, said means being shown as a pin 146 provided in the way of the shoulder 144. The pressure in the delaying cavity 70 continues to drop even after the balls 60 are stopped by holder means 62, and, when the angled piece 64 doesn't provide enough support for the balls 60, the mechanism unlatches.

Figure 30:
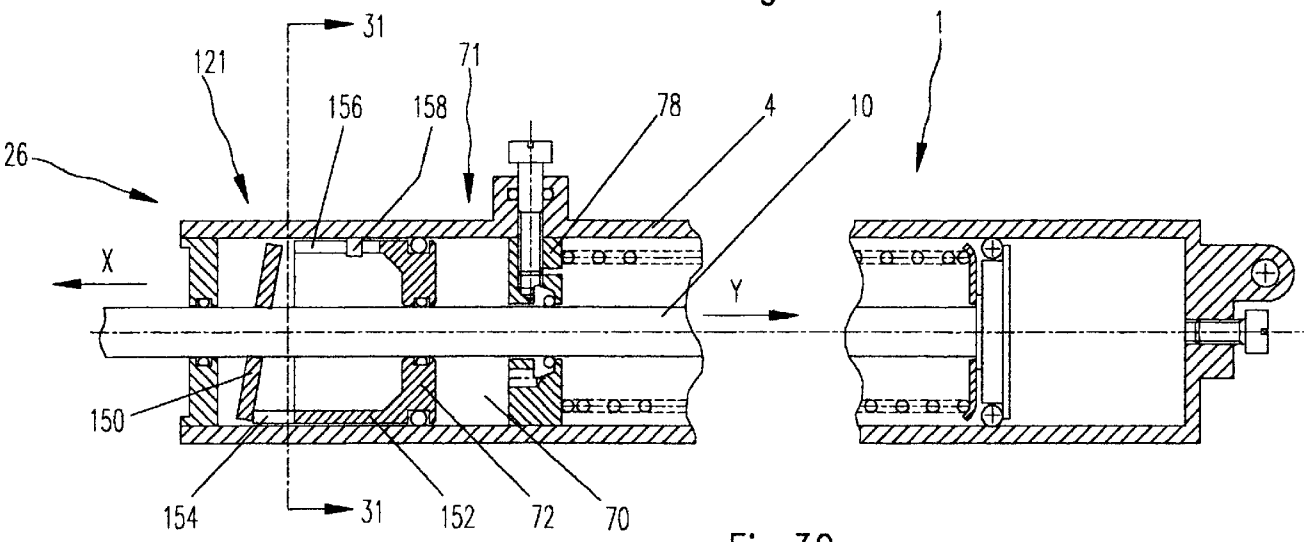
FIG. 30 is a longitudinal cross-sectional view through a door closer provided with delayed action; latching washer in conjunction with delaying chamber means shown.

FIG. 30 is a longitudinal sectional view through a door closer 1 provided with delayed action which has all the elements described in conjunction with the FIGS. 1 and 2 and where the function means 26 comprise:

Latching washer means 121 where the latching washer 150 can be of fully circular.

Delaying chamber means 71 which has all features as described in conjunction with FIGS. 15 through 18, except for a sliding eccentric axial support 152 shown as an extension to the free piston 72, but which can be a separated piece as well. The sliding support 152 is provided with a tooth 154 and a slot 156 opposite to said tooth.

Figure 31:
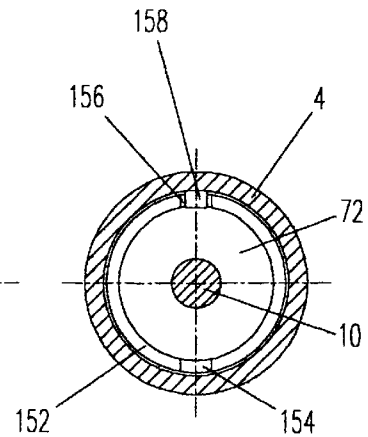
FIG. 31 is a cross-sectional view taken along the line 31—31 of FIG. 30.

Additional axial support means, shown as a tooth or projection 158, fixed inside the cylinder 4 inside the slot 156 as shown in FIG. 31.

During the opening stroke (rod 10 moving in the direction X) the free piston 72 and the sliding support 152 are driven in the direction X as described in conjunction with FIGS. 15 through 18. During the closing stroke (rod 10 moving in the direction Y) the latching washer 150, supported by the tooth 154 latches and the rod 10 continues to move slowly, movement controlled by the rate of metered flow of fluid out of the cavity 70 of the delaying chamber 71. Provision is made that, before the free piston 72 gets in contact with the diaphragm 78, the latching washer 150 starts to get additional support from the tooth 158 and unlatches.

Figures 32, 33, 34, 35:
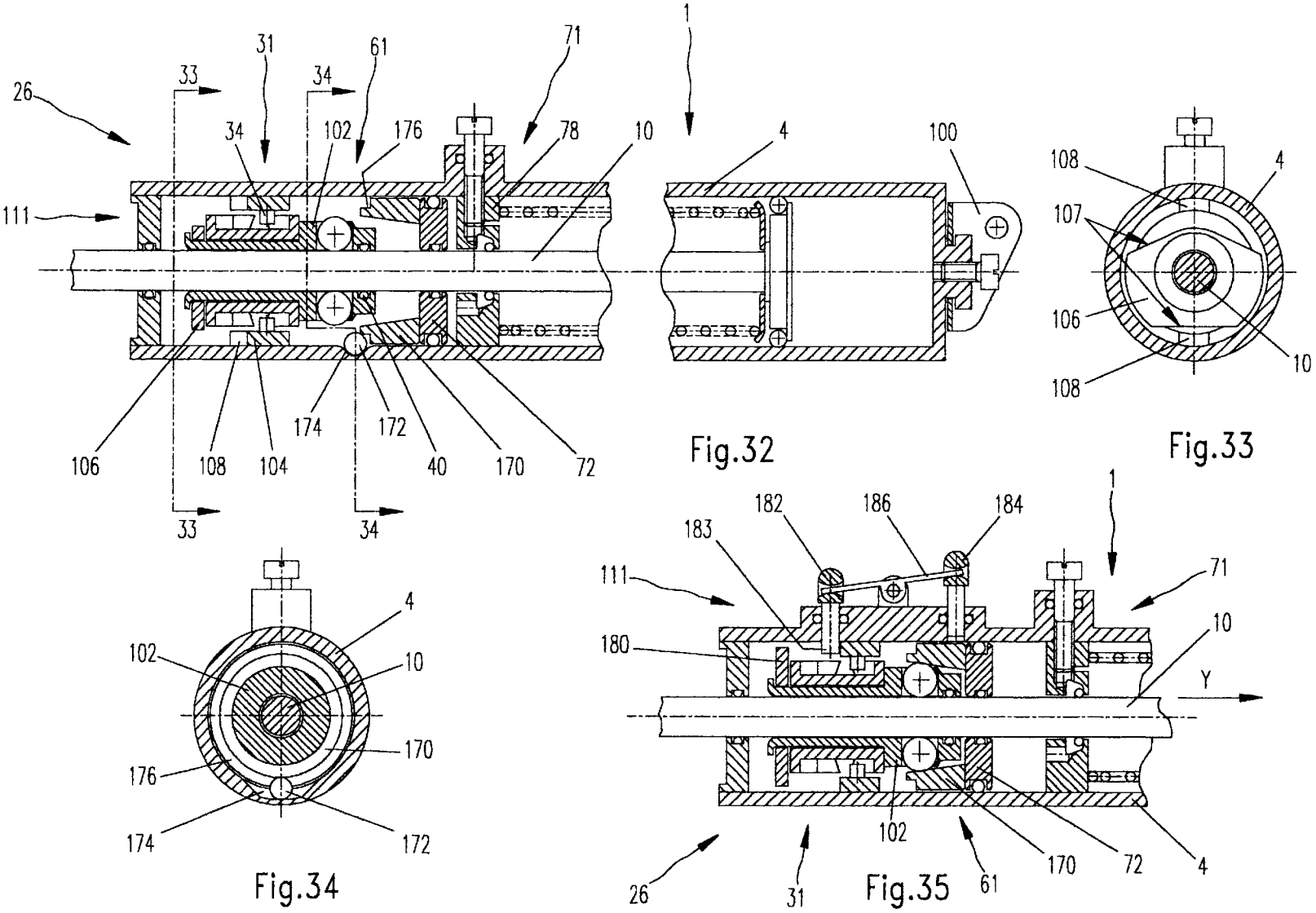
FIG. 32 is a longitudinal vertical cross-sectional view through a door closer provided with automatic latching and delayed action and turn around-centerline means to switch between the automatic latching and the delayed action operation modes.
FIG. 33 is a cross-sectional view taken along the line 33—33 of FIG. 32; cylinder is shown in the latching-on position.
FIG. 34 is a cross-sectional view taken along the line 34—34 of FIG. 32; cylinder is shown in the latching-on position.
FIG. 35 is a longitudinal partial cross-sectional view through a door closer provided with automatic latching and delayed action and pin-buttons means to switch between the automatic latching and the delayed action operation modes; delayed action operation mode on is shown.

FIG. 32 is a longitudinal vertical cross-sectional view through a door closer 1 provided with automatic latching, delayed action and turn around centerline type means to switch between the automatic latching and delayed action operation modes. In addition to the elements described in conjunction with FIGS. 1 and 2 this door closer is provided with means which allow the cylinder 4 being turned around its centerline as described in conjunction with FIG. 19.

The function means 26 comprise:

Cam means 31 and conical latching means 61, shown in the configuration which has been described in conjunction with FIG. 19 through 22, except for the angled piece 170 which is free to slide along the cylinder 4.

Delaying chamber means 71, shown in the configuration which has been described in conjunction with FIGS. 15 through 18.

Means to switch between the automatic latching and delayed action operation modes 111 which comprise the shaped limiting washer 106 and the associated means, as described in conjunction with FIGS. 19 through 22 and also comprise an essentially round, free piece means 172, named herein blocking ball, a recess means 174 in the wall of the cylinder 4 and a cut means 176 on the front end, outer diameter of the angled piece 170.

Automatic latching is switched-on and delayed action is switched off by turning the cylinder 4 around its centerline such that the blocking teeth 108 are placed out of the way of the shaped limiting washer 106 as shown in FIG. 33, the recess 174 being in this case on the bottom of the cylinder, as shown in FIGS. 32 and 34 and receiving in it the block ball 172 which prevents the axial movement of the angled piece 170 and of the free piston 72. In this aforesaid situation the automatic latching works as described in conjunction with FIGS. 19 through 22. Automatic latching is switched-off and delayed action is switched on by turning the cylinder 4 around its centerline such that the blocking teeth 108 are placed in the way of the shaped limiting washer 106 as shown in FIG. 21, the recess 174 being in this case on one side of the cylinder 4, the blocking ball 172 being free to move on the bottom of the cylinder. In this aforesaid situation, the angled piece 170 and the free piston 72 are enabled to slide along the cylinder 4 and the delayed action works as described in conjunction with FIG. 29. Depending on the depth of the recess 174 relative to the size of the blocking ball 172, the cut 176 in the angled piece 170 may or may not be necessary to block the movement of the angled piece 170.

FIG. 35 is a partial longitudinal cross-sectional view through a door closer 1 as described in conjunction with FIG. 32, except that the means to switch between automatic latching and delayed action operation modes 111 is of different type. The limiting washer 180 can be fully circular in this case and the strokes of the holder-carrier 102 and of the angled piece 170 (and inherently of the free piston 72) can be alternatively limited by two pin-buttons means, 182 and respectively 184, said pin-buttons being interconnected by lever means 186 such that, when one pin-button is pushed toward the cylinder 4, the other pin-button is retracted away from the cylinder 4. FIG. 35 shows the delayed action operation mode switched-on while the automatic latching is switched-off; the pin side 183 of the pin-button 182 protrudes in the cylinder 4 and limits the stroke of the holder-carrier 102 while the pin-button 184 is retracted, allowing the angled piece 170 to slide along the cylinder 4.

Having thus described the invention, what is claimed is novel and desired to be secured by letters patent of the United States is:

1. A door closer comprising:

an elongated cylinder having opposed ends, a partition disposed intermediate said elongated cylinder for defining therein a piston chamber and a delay chamber, a piston reciprocally mounted within said piston chamber, a piston rod connected to said piston, said piston rod extending through said delay chamber and beyond one end of said elongated cylinder, a compression spring disposed within said piston chamber between said partition and said piston for exerting a spring bias on said piston in a door closing direction, a free piston slidably mounted on said piston rod within said delay chamber and in sealing relationship therewith for relative axial movement toward and away from said partition within said delay chamber, whereby said free piston and partition define therebetween a variable delay cavity, said partition having means for metering the flow of a fluid medium between said delay cavity and said piston chamber to effect a time delay upon the closing stroke of the door closer.

2. A door closer as defined in claim 1 wherein said metering means includes a metering hole formed in said partition, and a valving means for controlling the direction of flow of a fluid medium through said metering hole between said piston chamber and delay cavity.

3. A door closer as defined in claim 2 and including an adjusting means for adjusting the flow of a fluid medium through said metering hole.

4. A door closer as defined in claim 1 and including a first seal means on said free piston defining a seal between said free piston and said elongated cylinder, and a second seal means defining a seal between said free piston and said piston rod.

5. A door closer as defined in claim 1 and including a means for effecting automatic latching of said piston rod to arrest the movement of said piston rod toward a door closing position, said latching means being disposed between said free piston and said one end of said cylinder.

6. A door closer as defined in claim 5 wherein said latching means includes a latching washer slidably mounted on said piston rod between said free piston and one end of said cylinder, and an eccentric support slidably disposed about said piston rod between said latching washer and said free piston for arresting the movement of said piston rod toward a door closing position, and a means for effecting the unlatching of said latching washer to effect the release of said piston rod as said free piston engages said partition as said piston is biased toward a door closing position.

7. A door closer as defined in claim 6 wherein said eccentric support comprises:

a tubular extension connected to said free piston and extending in the direction of said one end of said cylinder, a tooth connected to said tubular extension, and a slot formed in said tubular extension opposite said tooth, and a projection connected to said cylinder received within said slot for engaging said latching washer to effect the unlatching thereof as said free piston engages said partition as said piston is being biased toward a door closing position.

8. A door closer as defined in claim 7 and including means for optionally switching said latching means between operative and inoperative positions.

9. A door closer as defined in claim 5 wherein said latching means comprises an annular member having a tapered inner surface slidably disposed within said cylinder between said free piston and said one end wall, a bearing holder slidably mounted on said piston rod for relative movement with respect thereto, said bearing holder retaining thereon a plurality of bearing members arranged to effect the latching of said piston rod as said bearing members engage said tapered inner surface of said annular member as said piston is being biased toward a door closing position, and means connected to said cylinder to limit the movement of said holder toward a door closing position to effect the unlatching of said latching means.

10. A door closer as defined in claim 5 wherein said latching means comprises:

a cylindrical cam body rotatably mounted on said piston rod between said free piston and said one end of said cylinder, said cam body having a camming surface formed on the outer periphery of said cam body, a cam follower connected to said cylinder disposed in engagement with said camming surfaces.

* * * * *